US005184726A

United States Patent [19]

Box

[11] Patent Number: 5,184,726

[45] Date of Patent: Feb. 9, 1993

[54] FILE BOX COLUMN

[75] Inventor: Thomas Box, Shrewsbury, N.J.

[73] Assignee: Spectrum International, Inc., Shrewsbury, N.J.

[21] Appl. No.: 654,343

[22] Filed: Feb. 12, 1991

Related U.S. Application Data

[63] Continuation-in-part of Ser. No. 552,758, Jul. 16, 1990.

[51] Int. Cl.[5] ..... B65D 21/00

[52] U.S. Cl. ..... 206/509; 206/511

[58] Field of Search ..... 206/509, 511, 512; 220/23.4, 23.83; 211/126, 128

[56] References Cited

U.S. PATENT DOCUMENTS

| | | | |
|---|---|---|---|
| 1,112,943 | 10/1914 | Stone | 206/511 |
| 2,623,527 | 12/1952 | Guichard | 126/16 |
| 3,219,400 | 11/1965 | Bergquist | 206/511 X |
| 3,392,877 | 7/1968 | Sanders | 206/511 X |
| 3,750,892 | 8/1973 | Grosse | 206/509 X |
| 3,819,044 | 6/1974 | Bookenstette | 206/509 X |
| 4,015,713 | 4/1977 | Clipson et al. | 206/509 |
| 4,775,069 | 10/1988 | Stonier | 220/6 |
| 4,819,822 | 4/1989 | Box | 220/72 |

FOREIGN PATENT DOCUMENTS

| | | |
|---|---|---|
| 1043344 | 11/1953 | France . |
| 1198740 | 12/1959 | France . |
| 1337982 | 11/1973 | United Kingdom . |

*Primary Examiner*—Steven M. Pollard

*Attorney, Agent, or Firm*—Hedman, Gibson & Costigan

[57] ABSTRACT

The invention provides a clerical filing system that accommodates file folders, requires a minimum of space and affords ready and easy access to the file folders.

18 Claims, 7 Drawing Sheets

FILE BOX COLUMN

CROSS REFERENCE TO RELATED APPLICATION

This is a continuation-in-part of U.S. patent application Ser. No. 07/552,758, filed Jul. 16, 1990.

FIELD OF THE INVENTION

The invention relates to a clerical filing structure and systems. More particularly, the invention relates to a filing system comprised of individual filing boxes adapted to be arranged in a stacked column with means for access to each of the individual boxes of the stacked column.

BACKGROUND OF THE INVENTION

Clerical filing systems have taken on many forms to date. Fixed heavy-duty metal file cabinets with drawers that open beyond the contour of the filing cabinet have been developed in various forms. Deep drawer file cabinets with drawers opening to provide access to the drawer contents have been developed in many different designs. The designs include, among other structures, parallel rails structures that mount multiple hanging file folders.

In addition, individual containers such as Bankers Boxes have been developed to store file folders. The individual clerical file containers are formed of various materials, however, the conventional Bankers Box is a cardboard file container that is usually transportable. Currently, some of the transportable cardboard file folder containers are provided with parallel rails to suspend hanging file folders.

The art also includes foldable boxes for storing hanging file folders. U.S. Pat. No. 4,775,069 illustrates a foldable box for hanging files.

However, there does not exist a clerical filing system for hanging folders or otherwise accommodating conventional folders that enables either temporary or permanent storage of the folders in a demountable column wherein ready access is available to the files in each box in the column.

SUMMARY OF THE INVENTION

It is an object of the present invention to provide a clerical filing system that accommodates file folders, requires a minimum of space and affords ready and easy access to the file folders.

It is another object of the invention to provide a stacked column of individual file boxes that can be selectively removed or remain indefinitely in the stacked column.

It is a further objective of the present invention to provide a structurally sturdy clerical filing system that is readily transportable and easily assembled into a permanent or semi-permanent clerical filing column.

A still further objective of the present invention is the provision of a clerical filing assembly capable of storing and transporting hanging file folders.

It is also an objective of the present invention to provide a clerical filing assembly of the folder boxes that are completely interchangeable in a vertical column.

Thus, a plurality of essentially identically configured file folder boxes are provided. Each file folder box is provided with a bottom and four sides. The top of each file folder box is completely open. In the preferred embodiment, each box is rectangularly configured with two long longitudinal sides and two shorter lateral sides. The upper edges of the two lateral sides have two aligned recesses formed therein. The bottom of each box has two sets of guides depending downwardly. The guides extend from one lateral side to the opposite lateral side along the bottom of the box parallel to the longitudinal sides of the box. The guides are aligned with the recesses in the top of the box.

Bearing surfaces are formed on the top and bottom of the longitudinal sides. Two stop members are also provided at strategically located positions to limit the travel of each box with respect to the box below. In addition, means in the form of depending clips are provided to retain the boxes in the stacked mode and to enable full travel of a box with respect to the other boxes without causing any instability of the column.

In operation, the boxes may be stacked in a vertical column to effect the equivalent of a file cabinet. The guides on the bottom of the upper box fit within the recesses on each lateral end of the box below. The bearing surfaces mate and allow the upper box to slide on the bearing surface of the box immediately below. The stops on the bottom of the box limit travel to insure that maximum access to the contents of the box below the box that has been moved is provided while a safe stable condition of the vertical stack remains.

Each box of the column is provided with a rib structure that cooperates with the basic box structure to provide a sturdy structure capable of withstanding the stress imposed on the boxes during use and transport.

DESCRIPTION OF THE DRAWINGS

The present invention will be better understood when considered with the drawings wherein.

DESCRIPTION OF THE PREFERRED EMBODIMENT

Figure 1:
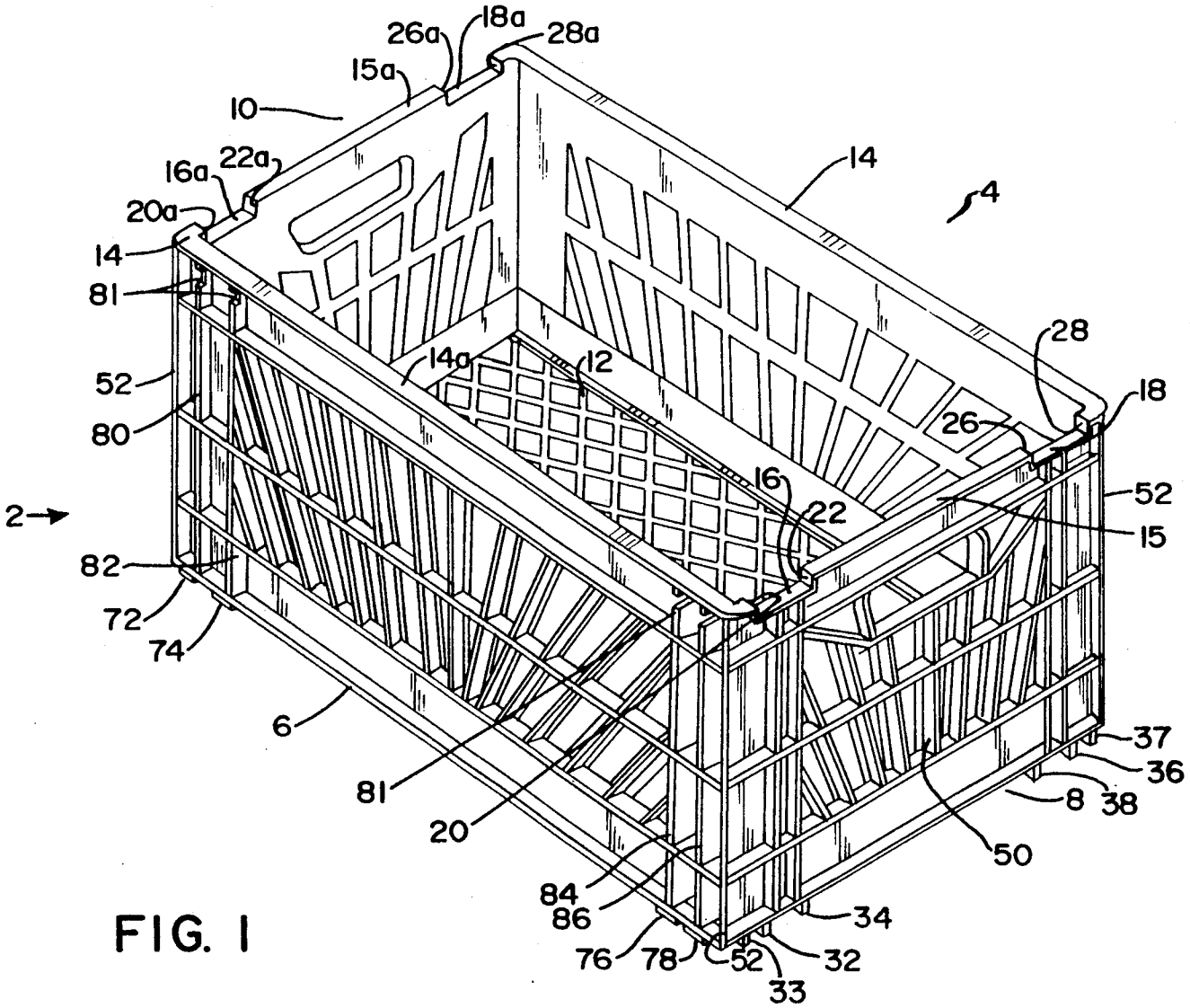
FIG. 1 is a perspective view of a box of the present invention.
Figure 2:
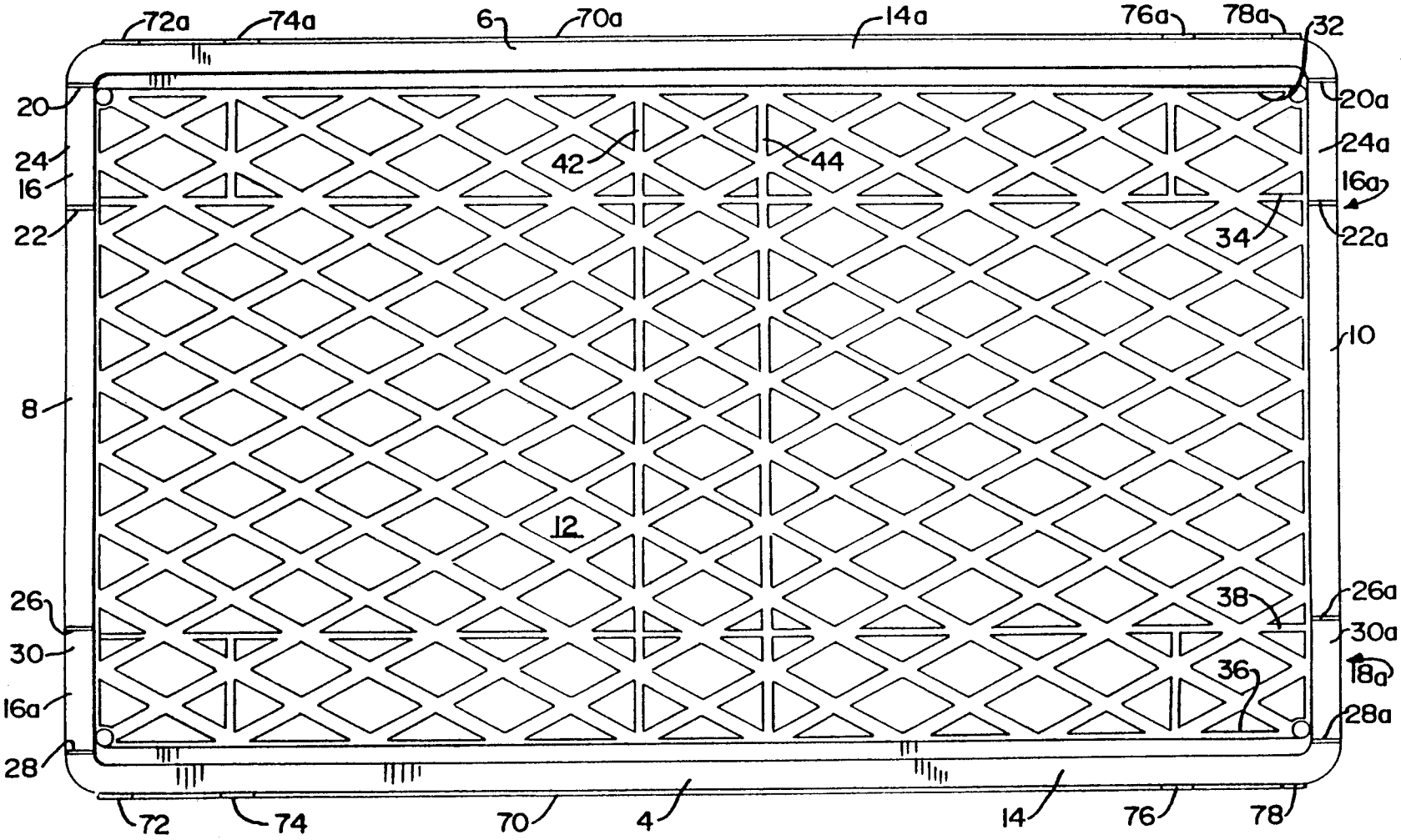
FIG. 2 is a top plan view of the box of FIG. 1.

The present invention is described in the preferred embodiment as a vertical column of boxes configured to accommodate hanging file folders. However, variations of the means for storing the contents of the boxes exist.

As best seen in FIG. 1–5, one basic box 2 of the present invention is comprised of two longitudinal sides 4 and 6, two lateral sides 8 and 10 and bottom or floor 12.

The longitudinal sides 4 and 6 extend from the floor 12 to upper rims 14 and **14*a* respectively that are formed at the top of the box 2**.

The lateral sides 8 and 10 extend from the floor 12 to an upper rim 15 and 15*a* respectively. Two recesses 16 and 18 are formed in the top of lateral side 8 and two recess 16*a*, 18*a* are formed in the top of lateral side 10. The recesses 16, 16*a*, 18, and 18*a* located in the respective opposite lateral sides 8 and 10 are in alignment with each other, i.e., the recesses 16 and 16*a* are the same distance from the longitudinal side 6 and recesses 18 and 18*a* are the same distance from the longitudinal side 4. The recess 16 is defined by vertical sides 20 and 22 and horizontal surface 24. Similarly recess 16*a* is defined by vertical sides 20*a* and 22*a* and horizontal surface 24*a*. The recess 18 is defined by vertical sides 26 and 28 and horizontal surface 30. The recess 18*a* is defined by vertical sides 26*a* and 28*a* and horizontal surface 30*a*.

Guides 32, 33, 34 and 36, 37, 38 are formed in the bottom of the box 2 of the preferred embodiment and extend from on lateral side 8 to the other lateral side 10. Guide 33 is parallel to longitudinal sides 4 and 6 and is located a distance from longitudinal side 4 to be adjacent the sides 20 and 20*a* of recesses 16 and 16*a*. Guide 34 is also parallel to longitudinal sides 4 and 6 but is adjacent to sides 22 and 22*a* of the recesses 16 and 16*a*. Guide 32 is parallel to longitudinal sides 4 and 6 and is located between guides 33 and 34. Similarly the guide 37 is parallel to longitudinal sides 4 and 6 but is located a distance from longitudinal side 6 to be adjacent to the sides 28 and 28*a* of recesses 18 and 18*a*. Guide 38 is parallel to longitudinal sides 4 and 6 but is adjacent to sides 26 and 26*a* of recesses 18 and 18*a*. Guide 36 is parallel to longitudinal sides 4 and 6 and is located between guides 37 and 38. Placement of guides 33 and 37 beneath wall 88 are preferably included for additional support to the stacking/interlocking area. Placement of guides 32 and 36 beneath the respective panels 92 and 94 provides vertical strength to the stacked boxes 2. In the preferred embodiment, the guides 32, 33, 34 and 36, 37, 38 are separate members but can be a solid configuration occupying the entire recess 16, 16*a* and 18, 18*a* respectively.

Figure 6:
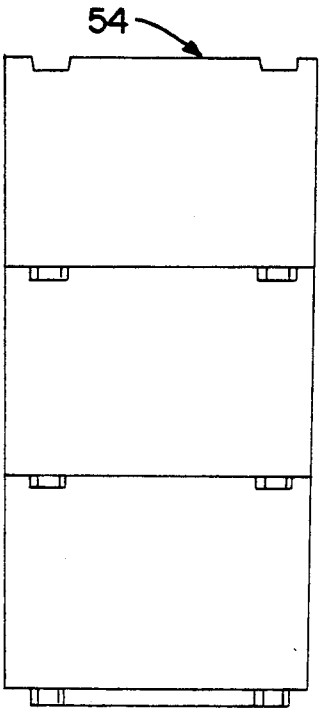
FIG. 6 is an elevational view of a vertical column of boxes.
Figure 7:
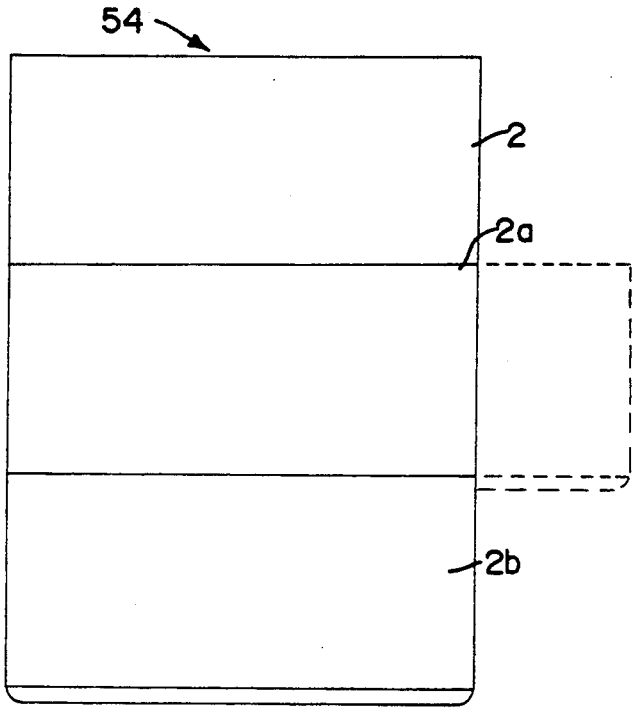
FIG. 7 is an elevational view of the vertical column of boxes of FIG. 6 with a box shown in an open position.

When a box 2 is placed on another box 2*a* as seen in FIGS. 6 and 7, the guides 32, 33, 34 and 36, 37, 38 depend downwardly toward the horizontal surfaces 24, 24*a* and 30, 30*a* of the recesses 16, 16*a*, and 18, 18*a*. In practice, the guides 32, 33, 34, 36, 37, 38, are slightly shorter (about ¼ inch) than the vertical sides 20, 22, 20*a*, 22*a*, 26, 28, 26*a* and 28*a* of the recesses 16, 16*a* and 18, 18*a*.

Figure 3:
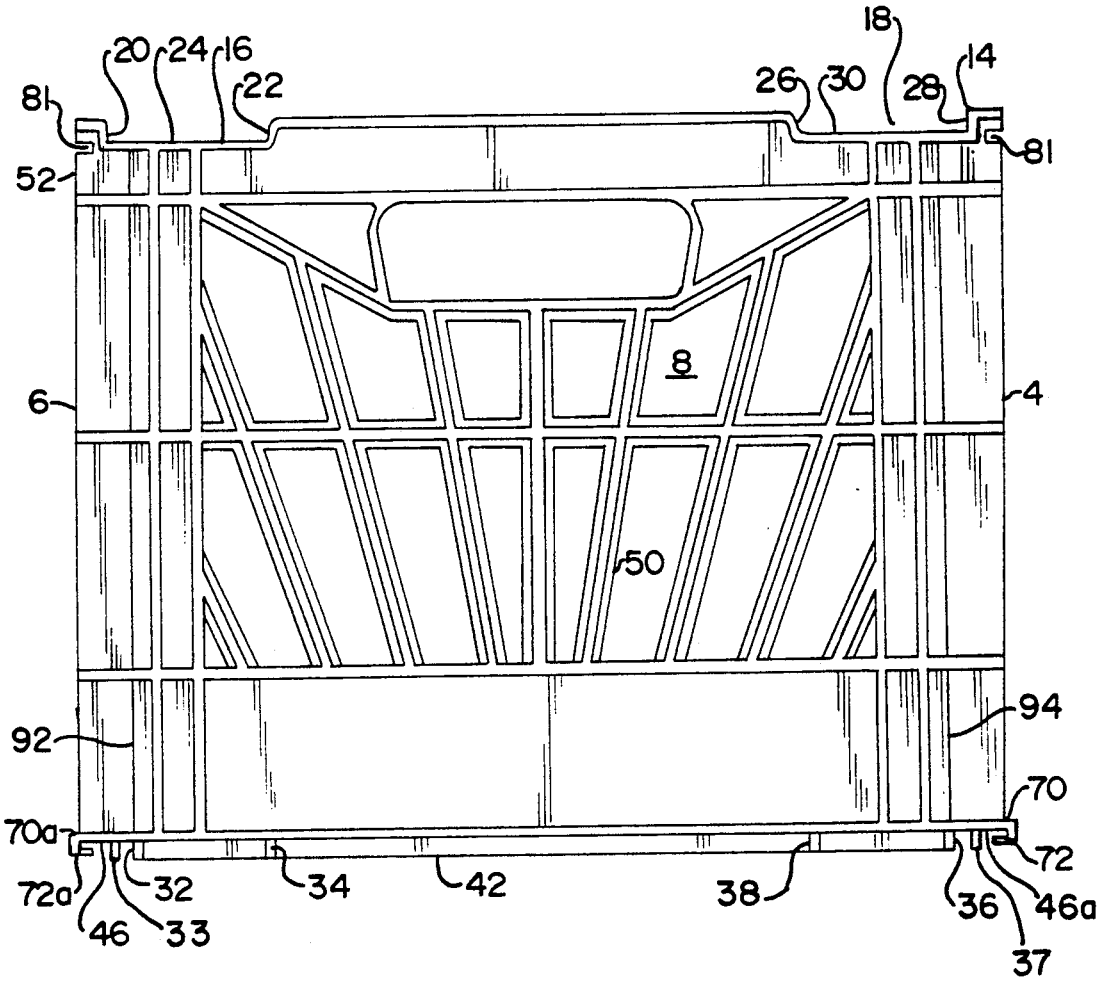
FIG. 3 is a side elevational view of one lateral side of the box of FIG. 1
Figure 4:
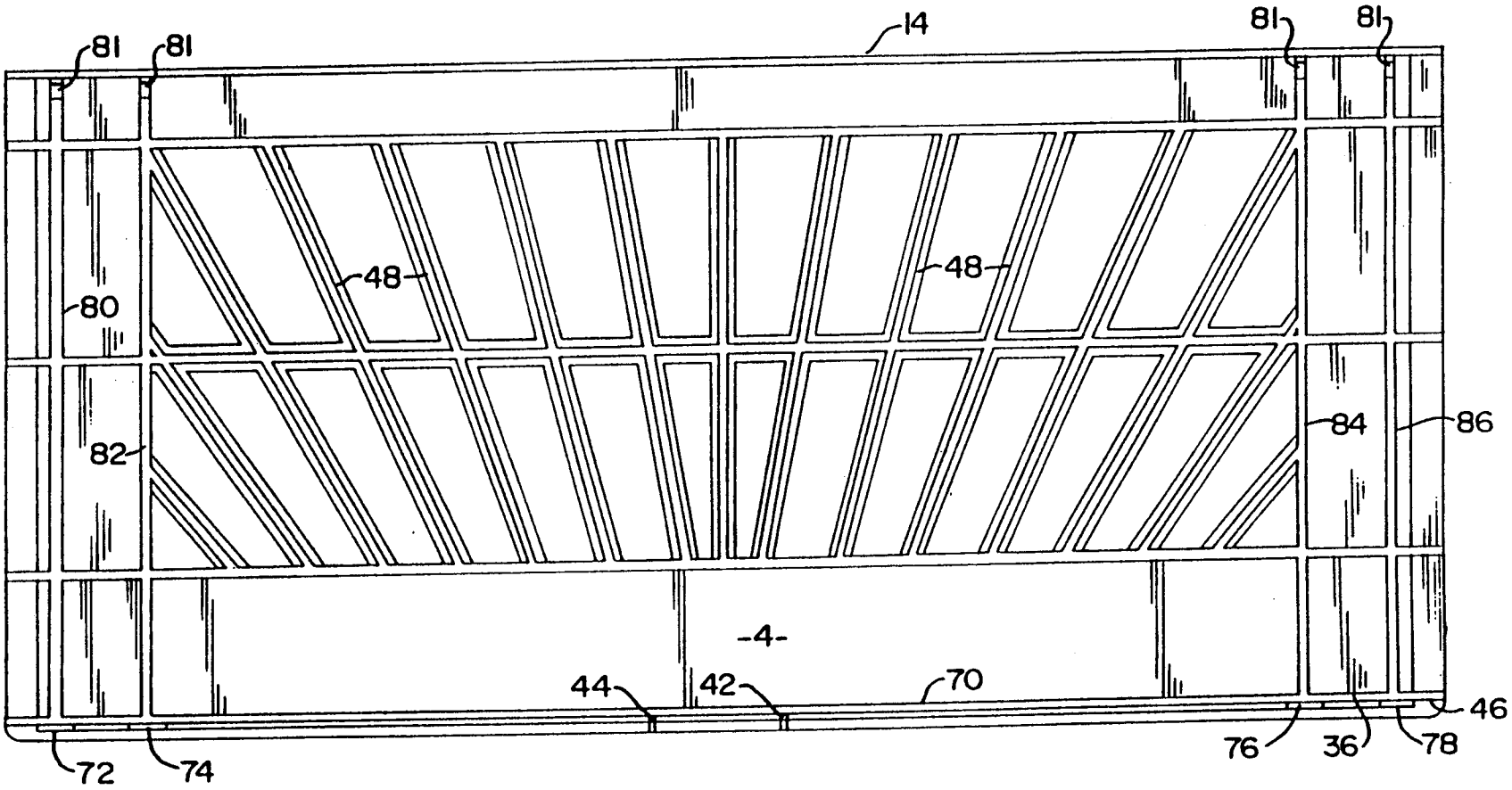
FIG. 4 is a side elevational view of one longitudinal side of the box of FIG. 1.
Figure 9:
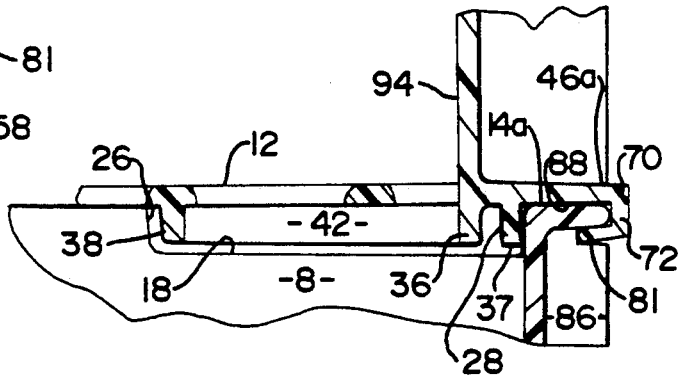
FIG. 9 is an enlarged detail drawing of the guide and bearing surface structure of two stacked boxes.

As can be seen in FIG. 3 and 9, the bottom edges 46 and 46*a* of the longitudinal sides 4 and 6 bear on the top edges 14 and 14*a* of the longitudinal sides 4 and 6 of the box 2*a* on which the upper box 2 is seated. The edges 14, 46 and 14*a*, 46*a* are the bearing surfaces on which the upper box 2 slides on the lower box 2*a*.

In addition, ribs 70 and 70*a* extend outwardly from each respective bottom edge 46 and 46*a*. The ribs 70 and 70*a* extend almost the entire length of the longitudinal sides 4 and 6 of the box 2. Clips 72, 74, 76, 78 and 72*a* , 74*a*, 76*a*, 78*a* are formed around each rib 70 and 70*a* respectively at strategic locations. Clips 72, 74, 76, 78, and 72*a*, 74*a*, 76*a*, 78*a* are located on each rib 70 and 70*a* in alignment with the respective vertical ribs 80, 82, 84, 86 and 80*a*, 82*a*, 84*a*, 86*a*, best seen in FIGS. 1, 2 and 4. Slots 81 are formed at the top of each vertical rib 80, 82, 84, 86, 80*a*, 82*a*, 84*a*, 86*a* to enable sliding movement of a box 2 with respect to another box 2*a* without interference with the clips 72, 74, 76, 78 and 72*a*, 74*a*, 76*a*, 78*a*. The location of the clips 72, 74, 76, 78 and 72*a*, 74*a*, 76*a*, 78*a* in vertical alignment with the vertical ribs 80, 82, 84, 86 and 80*a*, 82*a*, 84*a*, 86*a* provides a configuration in which the clips 72, 74, 76, 78 and 72*a*, 74*a*, 76*a*, 78*a* each occupy a slot 81 when a column of boxes 2, 2*a*, 2*b*, etc. are in vertical alignment and thereby affords enhanced structural integrity to the column.

Figure 5:
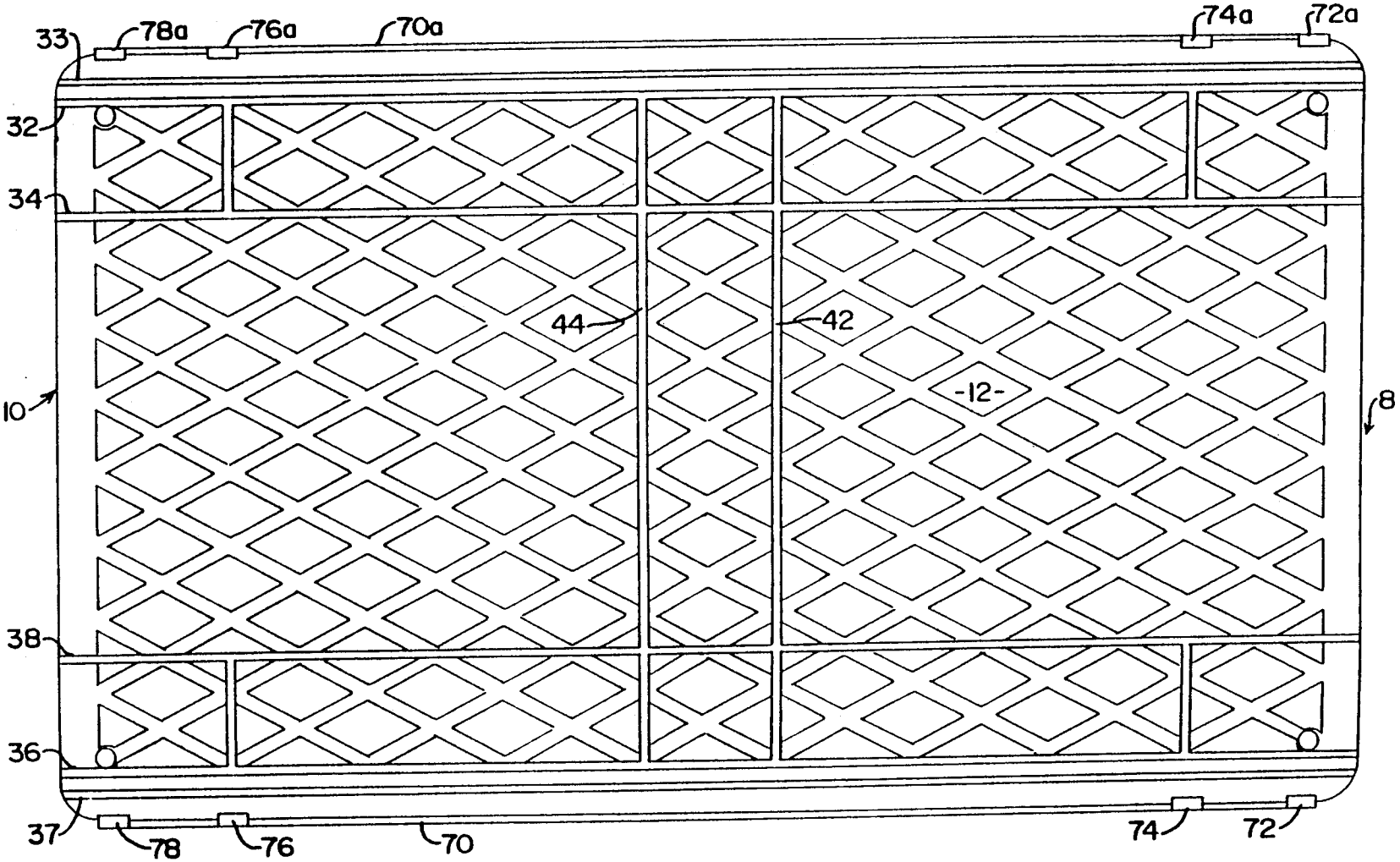
FIG. 5 is a bottom plan view of the box of FIG. 1.

Stops 42 and 44, best seen in FIG. 5, are arranged transversely at the bottom of each individual box 2. The stops 42 and 44 limit the amount of travel that can occur when a box 2 slides with respect to a box 2*a* on which it is seated. Further, the stops 42 and 44 form part of the reinforcement structure of each box 2. In practice, the stops 42 and 44 are located about forty-four percent of the distance from the respective lateral sides 8 and 10. Illustratively, in a box 2 having a longitudinal length of 24 inches, the stop 42 will be 10.75 inches from the lateral side 8 and the stop 44 will be 10.75 inches from the lateral side 10.

The reinforcement structure is comprised of the top flange formed of the rims 15, 15*a* and rims 14, 14*a*, a bottom continuous rim, diagonally or angularly arranged ribs 48 that extend from top to bottom on the longitudinal sides 4 and 6 and similarly configured ribs 50 that extend from top to bottom of the lateral sides 8 and 10. Edge ribs 52 are located in each of the four corners of each box 2 and vertical ribs 80, 82, 84, 86 and 80*a*, 82*a*, 84*a*, 86*a* are provided on each respective longitudinal side 4, 6.

As best seen in FIGS. 6 and 7, a vertical column 54 formed of three stacked boxes 2, 2*a* and 2*b* provides, in effect a composite filing system. Access to the lower boxes, such as box 2*a*, is gained by sliding the top box 2 either forward or backward on the bearing surfaces 14 and 46 with the guides 32, 33, 34 and 36, 37, 38 in the respective recesses 16, 16*a* and 18, 18*a* in the box 2*a*. Sliding movement of the top box 2 is limited by the stop 42 or 44 which abut the upper inside lateral wall of side 8 or 10, depending on the direction in which the box 2 is moved with respect to box 2*a*, or box 2*a* moved with respect to boxes 2 and 2*b*.

The boxes such as 2 and 2*a*, are assembled in the column 54 by sliding or threading the clips 72, 72*a*, 74, 74*a*, 76, 76*a*, 78 and 78*a* onto the edges of the upper surfaces 14 and 14*a* respectively. In practice, it has been found that an allowance area need not be provided in the clip structure. Thus, with an edge thickness of 3.5 mm (0.137 in.) for the upper surfaces 14 14*a*, and a thickness of 5.6 mm (0.220 in.) for the clip material, the inherent resiliency of polypropylene, polyethylene or similar materials enables an upper box 2 to be mounted on a lower box 2*a* by threading the forward clips 72, 74 and 72*a*, 74*a* on each rib 70, 70*a* extending from the surfaces 46 and 46*a* respectively onto the upper surfaces 14 and 14*a* of the box 2*a*, sliding the box 2 toward vertical alignment with the box 2*a* until the stops 42 and 44 approach a lateral wall 8 or 10 of the lower box 2*a* and tilting the box 2 upwardly to elevate the stops 42 and 44 over the lateral wall. After the box 2 has been moved on the upper surfaces 14 and 14*a* of the lower box 2*a* to a location wherein the stops 42 and 44 are beyond the lateral wall, the upper box 2 is dropped down to again bear on the surface 14 and 14*a* of the lower box 2*a* and is moved to thread the rear clips 76, 76*a*, 78 and 78*a* onto the surface 14 and 14*a*.

Figure 10:
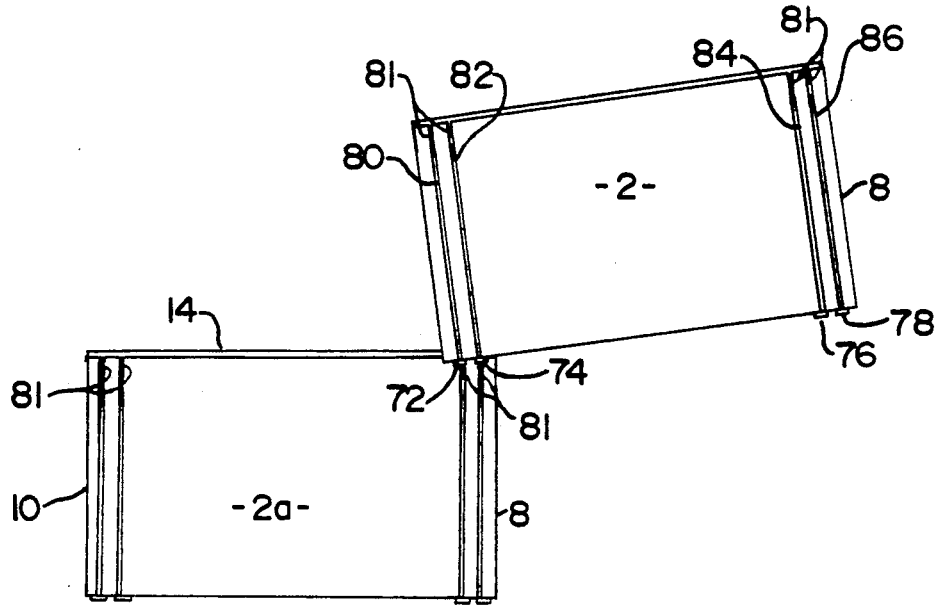
FIGS. 10–12 are an illustration of the boxes of the invention being assembled into a column of boxes.
Figure 11:
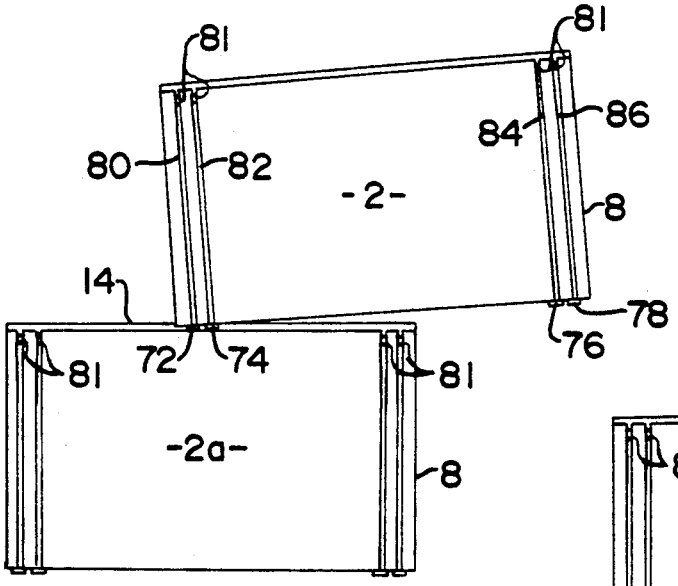
Figure 12:
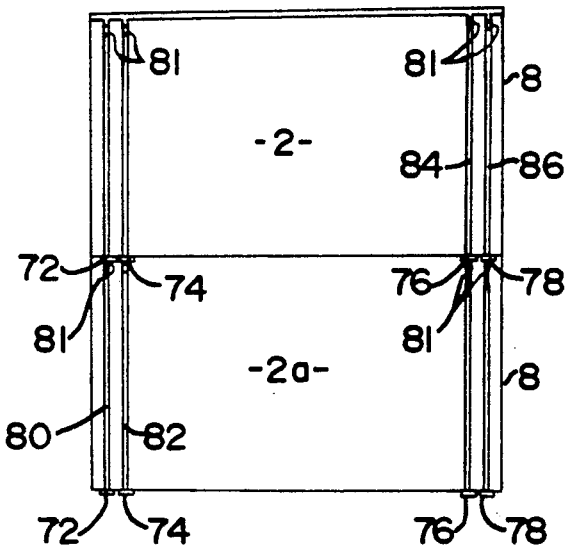

FIGS. 10–12 illustrate a box 2 being mounted on a box 2*a*. The leading edge clips 72, 74 and 72*a*, 74*a* are first threaded onto the surfaces 14 and 14*a* of box 2*a*. The box 2 is then moved from lateral wall 8 toward lateral wall 10 until the stops 42 and 44 on the bottom of the box 2 are in the region of the lateral wall 8 of the box 2a, at which time the lateral wall 8 of the box 2 is tilted upwardly as seen in FIG. 11, and the box 2 is moved over the lateral wall 8 of box 2a with the stops 42 and 44 above the upper edge of the lateral wall 8 of box 2a. The box 2 is then lowered to the upper surfaces 46 and 46a of the lower box 2a and slides toward the lateral edge 10 of the lower box 2a enabling the clips 76, 76a and 78, 78a to thread onto the upper surfaces 14 and 14a of the lower box 2a.

Alternatively, one box can be first placed on top of another box 2a with the stops 42 and 44 within the confines of the lateral walls 8 and 10. Then the box 2 on top can be moved in the direction of a lateral wall 10 until the leading edge clips 72, 72a, 74 and 74a are beyond the lateral wall 10. Next the box 2 is moved back toward the lateral wall 8 and the clips 72, 72a, 74 and 74a are threaded onto the top surfaces 14 and 14a of the box 2a. Travel of the box 2 continues in the direction of the lateral wall 8 until the clips 76, 76a, 78 and 78a are beyond the lateral wall 8. The box 2 is then moved back toward lateral wall 10 to thread the clips 76, 76a, 78 and 78a onto the surfaces 14 and 14a. During the back and forth movement of the box 2 to effect the threading procedure, the stops 42 and 44 never are required to travel far enough to bear against the inner surfaces of the lateral walls 8 and 10.

Figure 8:
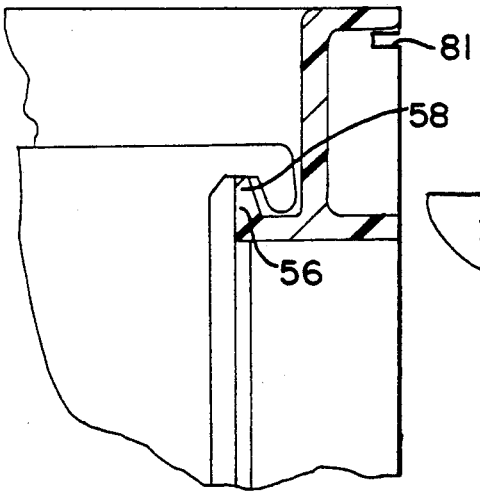
FIG. 8 is a detail drawing of the file mounting structure of the box of FIG. 1.

As best seen in FIG. 8, mounting means in the form of hook-like extensions 56 are formed along the interior of the longitudinal sides 4 and 6 at an elevation below the horizontal plane defined by the bottoms of the guides 32, 33, 34, 36, 37 and 38 and the bottoms of the stops 42 and 44. The extensions 56 are formed with upper edges 58 on which hanging folders 60 can be mounted. The location of the hook-like extensions 56 below the plane defined by the bottom of the rails 32, 34, 36, 38 and the stops 42, 44 enables unimpeded travel of one box 2 with respect to a box 2a on which it is mounted.

At this time is contemplated that the best mode of the invention is a single piece structure as shown in the drawings made of a plastic such as polypropylene or polyethylene by conventional injection molding techniques.

I claim:

1. A storage box comprising:

a. two longitudinal sides;

b. two lateral sides;

c. bearing means for facilitating sliding of said box;

d. guide means on said box;

e. stop means for limiting the distance that the box can travel when mounted on a similarly configured box;

f. means for slidably retaining said storage box to a similarly configured box comprising a plurality of strategically located clips extending outwardly from the bottom of the box which engage edge means on the top of an adjacent box;

g. a first and second rib extending outwardly from the bottom of each longitudinal side respectively; and h. four vertical ribs on each longitudinal side having slots at the top of each said vertical rib with the clips for retaining the storage box to a similarly configured box each located in vertical alignment with a said vertical rib.

2. A storage box as in claim 1 wherein the stop means for limiting the distance that the box can travel when mounted on a similarly configured box is comprised of a member depending downwardly from the bottom of the storage box, the bottom of said depending member being at an elevation below the top of the guides extending longitudinally on the bottom of the box.

3. A storage box assembly formed of a plurality of storage boxes comprising:

a first box comprised of two longitudinal sides; two lateral sides, a recess in one lateral side; a recess in the other lateral side, said recesses being in alignment at the same vertical elevation and an upper bearing surface;

a second box comprised of two longitudinal sides; two lateral sides and a bottom; guide means on the bottom of said second box located in vertical alignment with the recesses on said first box and a lower bearing surface and stop means for limiting the distance that the second box can slidably move on the first box comprised of a member depending downwardly from the bottom of the second box and extending transversely with respect to said second box;

whereby the second box can be mounted for slidable movement on the first box with the guide means on the second box in the recesses in the first box and the lower bearing surface of the second box seated on the upper bearing surface of the first box said assembly further comprising means for slidably retaining one box of the assembly to the box below it in the assembly comprising ribs extending outwardly from the bottom of each side and a plurality of clips extending outwardly and downwardly from each rib which engage edge means on the top of the lower box further comprising a plurality of vertical ribs extending from top to bottom on each longitudinal side; a slot at the top of each said vertical rib and wherein each of the plurality of clips is aligned with a said vertical rib when the boxes are in an aligning vertical relationship.

4. A storage box assembly as in claim 3 further comprising a plurality of recesses in the top of one lateral side of the first box and an equal number of recesses in the other lateral side at the same elevation as the recesses in the top of the one lateral side, each of said recesses in the one lateral side being in alignment with a recess in the other lateral side to form aligned pairs of recesses.

5. A storage box assembly as in claim 4 wherein the bearing means is comprised of an upper rim extending the entire length of each longitudinal side and a lower rim extending the entire length of each longitudinal side.

6. A storage box assembly as in claim 5 wherein the guide means on the bottom of the second box is comprised of a plurality of guides in alignment with each pair of recesses in the lateral sides of the first box.

7. A storage box assembly as in claim 6 wherein each recess is comprised of two vertical sides and a horizontal surface; each of the plurality of guides is comprised of two or more vertical guides.

8. A storage box assembly as in claim 7 wherein the stop means is comprised of a member depending downwardly from the bottom of the second box transversely to the guide means.

9. A storage assembly as in claim 6 wherein the stop means are comprised of a stop member extending transversely from one longitudinal wall to the other longitudinal wall, the bottom of which is the same elevation as the horizontal surface of the guides, said stop member being located about 44 percent of the distance from the one lateral wall to the other opposite lateral wall.

10. A storage box assembly as in claim 9 wherein the stop means are further comprised of a second stop member extending transversely from one longitudinal wall to the other longitudinal wall, the bottom of which is at the same elevation as the horizontal surface of the guides said stop member being located about 44 percent of the distance from the opposite lateral wall to the one lateral wall.

11. A storage box assembly as in claim 10 wherein the first box is further comprised of a plurality of guides on the bottom located in vertical alignment with the aligned pair of recesses at the top of the second box and the second box is further comprised of a plurality of recesses in the top of one lateral side and an equal number of recesses in the other lateral side at the same elevation and configured the same as the recesses in the one lateral side, each said recess in one lateral side being in alignment with a recess in the other lateral side to form aligned pairs of recesses.

12. A storage box assembly as in claim 11 further comprising additional identically configured storage boxes arranged in a stacked column.

13. A storage box assembly as in claim 12 wherein the boxes are formed of a material from the group consisting of polyethylene and polypropylene.

14. A storage box assembly as in claim 13 further comprising means for suspending file folders.

15. A storage box assembly as in claim 14 wherein the means for suspending file folders are hook like extensions having substantially vertical upper edges formed on the interior surface of longitudinal walls of each box, said hook-like extensions located at an elevation to mount the entire suspending file below the horizontal surfaces of the guides and the lowest depending point of the stop members wherein the substantially vertical upper edges of the hook like extensions are directly above the longitudinal sides.

16. A storage box assembly as in claim 15 further comprising reinforcing means for each box of the storage box assembly.

17. A storage box assembly as in claim 11 further comprising means for retaining an upper box of the assembly to a lower box of the assembly.

18. A storage box assembly formed of a plurality of storage boxes comprising:

a first box comprised of two longitudinal sides; two lateral sides, a recess in one lateral side; a recess in the other lateral side, said recesses being in alignment at the same vertical elevation and an upper bearing surface;

a second box comprising of two longitudinal sides; two lateral sides and a bottom; guide means on the bottom of said second box located in vertical alignment with the recesses on said first box and a lower bearing surface and stop means for limiting the distance that the second box can slidably move on the first box;

whereby the second box can be mounted for slidable movement on the first box with the guide means on the second box in the recesses in the first box and the lower bearing surface of the second box seated on the upper bearing surface of the first box said assembly further comprising a plurality of vertical ribs on each longitudinal side of each box; a slot at the top of each said vertical rib; a horizontal rib extending outwardly from the bottom of each longitudinal side and means for slidably retaining an upper box of the assembly to the box below it in the assembly wherein the means for retaining an upper box of the assembly to a lower box of the assembly is comprised of a plurality of clips extending outwardly from each said horizontal rib at the bottom of each longitudinal side which engage edge means on the top of the first box; each of said plurality of said clips located in vertical alignment with each said vertical rib.

* * * * *